US006396375B1

(12) United States Patent
Lee

(10) Patent No.: US 6,396,375 B1
(45) Date of Patent: May 28, 2002

(54) DRIVING MECHANISM FOR LIQUID-CONTAINING ORNAMENT

(76) Inventor: Vincent K. Lee, 4F No. 48 Lane 10 Chi Fu Rd, Taipei 114 (TW)

( * ) Notice: Subject to any disclaimer, the term of this patent is extended or adjusted under 35 U.S.C. 154(b) by 0 days.

(21) Appl. No.: 09/985,981

(22) Filed: Nov. 7, 2001

(51) Int. Cl.[7] ..... G09F 19/00

(52) U.S. Cl. ..... 335/285; 40/426; 446/133; 446/134; 446/136; 335/306

(58) Field of Search ..... 335/285, 306; 40/406, 414, 423, 426, 429, 430; 446/131, 133–136, 352

(56) References Cited

U.S. PATENT DOCUMENTS 4,432,544 A * 2/1984 Wakimura ..... 273/140
4,852,283 A * 8/1989 Teng ..... 40/410
5,189,821 A * 3/1993 Lee ..... 40/406
5,301,444 A * 4/1994 Horiuchi ..... 40/406
5,463,826 A * 11/1995 Horiuchi ..... 40/426
5,595,141 A * 1/1997 Udelle et al. ..... 119/706

* cited by examiner

*Primary Examiner*—Ramon M. Barrera
(74) *Attorney, Agent, or Firm*—Dougherty & Troxell

(57) ABSTRACT

A driving mechanism is located below a transparent hollow casing of a liquid-containing ornament and includes a coupling member that engages with and rotates along with a rotary shaft of a movement of a music box located below the mechanism, stationary magnets that have a fixed polarity and are fixedly mounted at two ends of the coupling member, and rotary magnets that are rotatably mounted on the coupling member in the vicinity of the stationary magnets to freely change their polarities while rotating. The stationary and the rotary magnets alternately magnetically attract and repulse a plurality of magnet-attached floating ornamental items in the casing, causing the ornamental items to move just like something real.

4 Claims, 7 Drawing Sheets

DRIVING MECHANISM FOR LIQUID-CONTAINING ORNAMENT

BACKGROUND OF THE INVENTION

The present invention relates to a liquid-containing ornament, and more particularly to a driving mechanism that enables a plurality of magnet-attached floating ornamental items in a liquid-containing ornament to swing just like something real and thereby creates a unique decorative effect.

While the highly developed industrial technologies enable constant upgrade of people's living quality, people require more about the articles they are going to buy. General consumers would prefer to articles that are cost-effective and show novel and unique structural design and spatial arrangement. A liquid-containing ornament is a popular interior decoration that typically has a structure being restricted to a transparent hollow casing for containing one or two types of liquid and one or more floating ornamental items, and a base for supporting the casing and accommodating necessary driving mechanisms to produce dynamic changes in the liquid and/or movements of the floating ornamental items in the liquid. To create a novel and unique liquid-containing ornament, a designer must try to break through the above-described typical structural form and to provide newer technical means to create dynamic scenes in the liquid-containing ornament to meet most consumers' requirements. It is therefore tried by the inventor to develop an improved liquid-containing ornament, so that floating ornamental items in the liquid of the ornament moves while swinging just like something real to create unique decorative effect.

SUMMARY OF THE INVENTION

A primary object of the present invention is to provide a driving mechanism for a liquid-containing ornament, so that floating ornamental items in the liquid contained in a transparent hollow casing of the ornament are alternately magnetically attracted and repulsed by stationary and rotary magnets on a rotatable coupling member of the driving mechanism to show movements just like something real.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
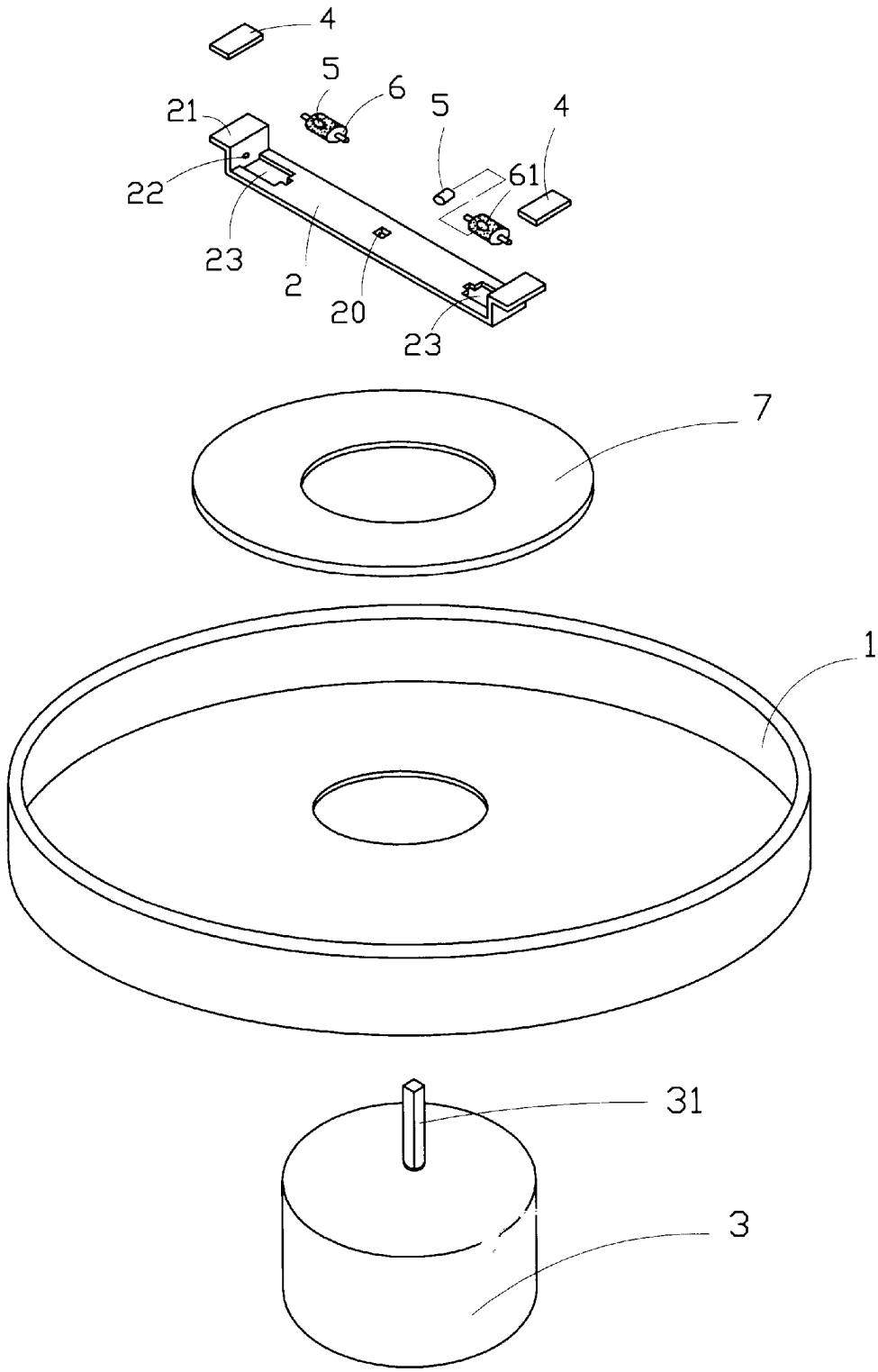
FIG. 1 is an exploded perspective view of the present invention.
Figure 2:
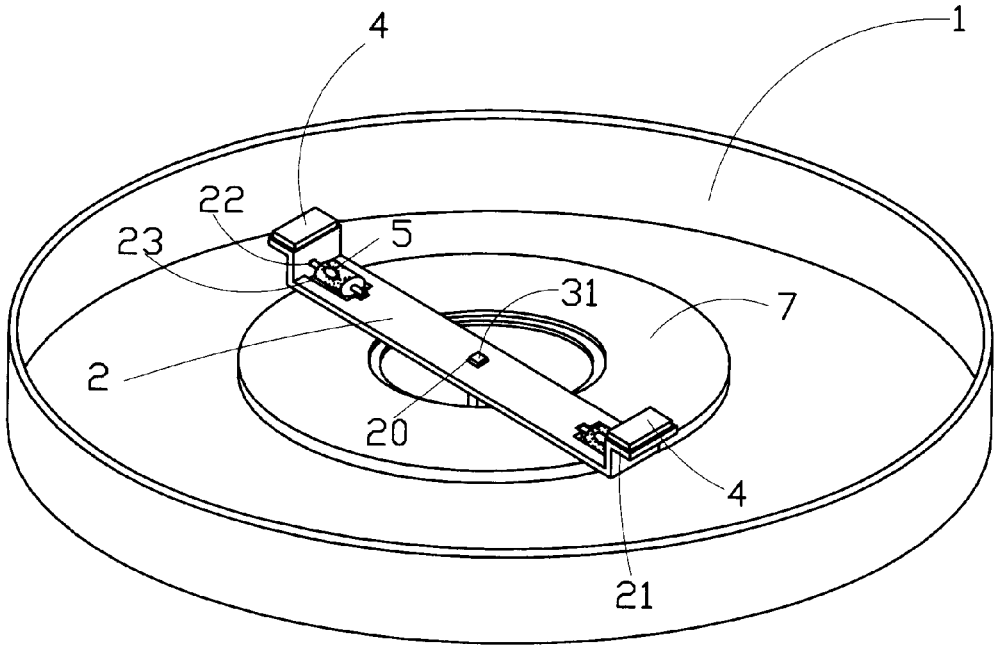
FIG. 2 is an assembled perspective view of the present invention.

Please refer to FIGS. 1, 2, 5 and 7. The present invention is a driving mechanism being located in an intermediate chamber 1 below a transparent hollow casing 9 and above a base of a liquid-containing ornament.

The driving mechanism of the present invention includes a coupling member 2, which may be a disc or a long plate without particular limitation in its configuration. In the illustrated figures, the coupling member 2 is a long plate on which a hole 20 is provided at a predetermined position. A movement 3 of a music box is mounted in the base of the liquid-containing ornament and has a rotary shaft 31 upward extended into the intermediate chamber 1 to engage with the hole 20 of the coupling member 2, so that the coupling member 2 is brought by the movement 3 to rotate along with the rotary shaft 31.

Figure 3:
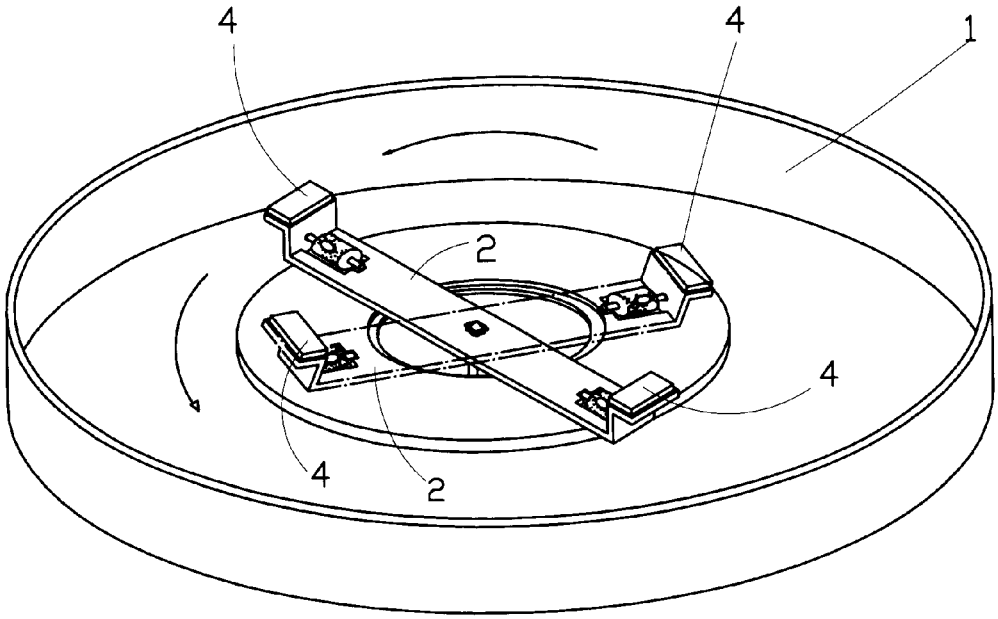
FIG. 3 shows a coupling member of the present invention is rotated by a movement of a music box.
Figure 4:
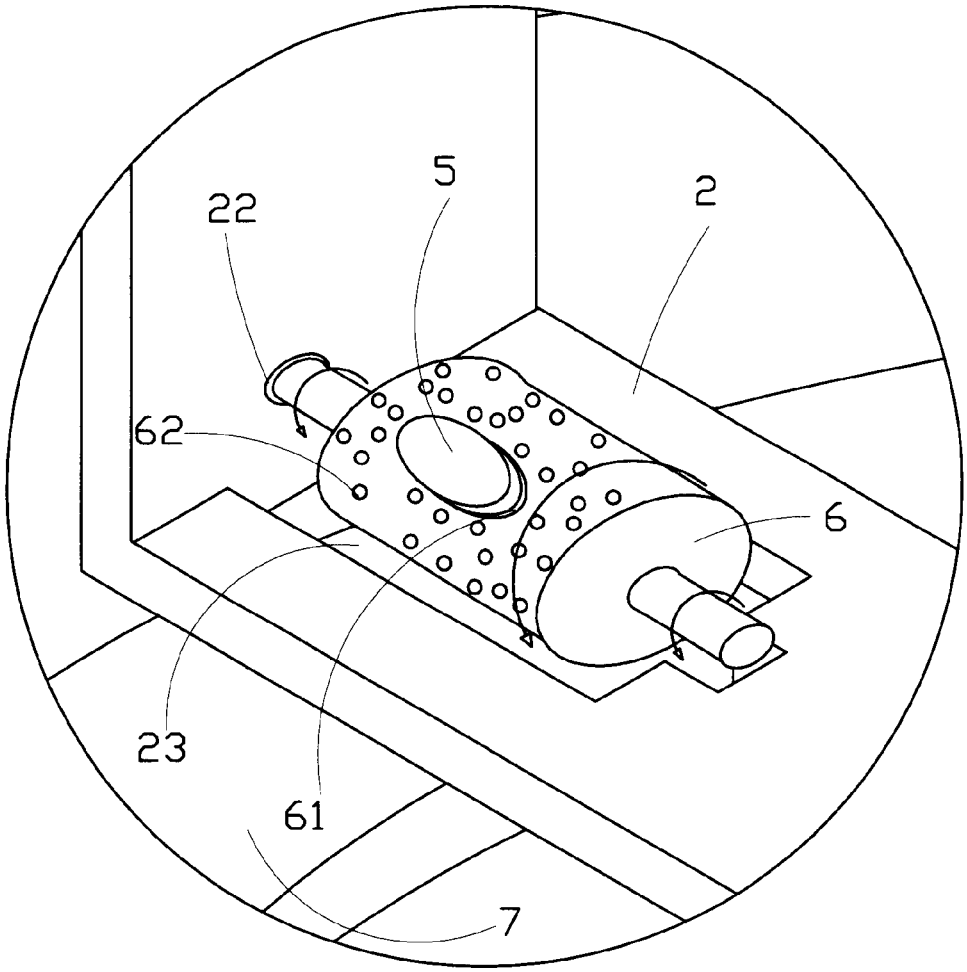
FIG. 4 is a fragmentary, enlarged perspective view of FIG. 3 showing some related components of the present invention.
Figure 5:
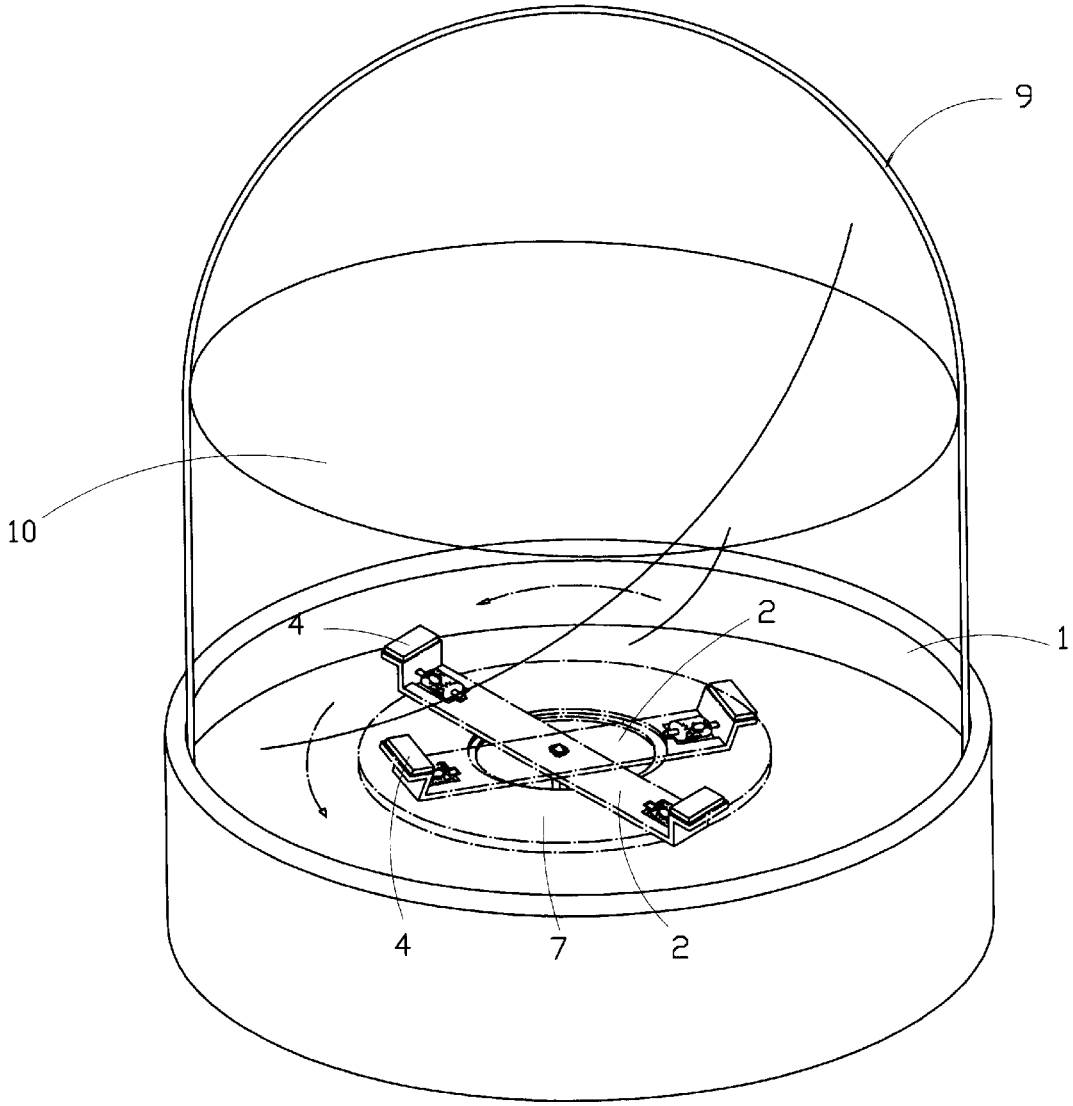
FIG. 5 is a perspective view showing the coupling member of the present invention is employed in a liquid-containing ornament.

The coupling member 2 is provided on at least one end with a stationary magnet 4 that has a fixed type of polarity, and at least one rotary magnet 5 that is freely rotatable to change its polarity when the coupling member 2 is rotated. The at least one stationary magnet 4 having a fixed polarity is mounted on a top surface of an end of the coupling member 2, and the at least one rotary magnet 5 is located in the vicinity of the at least one stationary magnet 4. The rotary magnet 5 may be a spherical body or a cylindrical body 6 and always has its two different polarities (that is, N pole and S pole) exposed from two opposite ends on an outer surface of the spherical or the cylindrical body 6. In the illustrated embodiment of the present invention, the at least one stationary magnet 4 having a fixed polarity is fixedly mounted on a bent end surface 21 of the coupling member 2, and the at least one rotary magnet 5 is inserted into a radial bore 61 on a cylindrical body 6. The cylindrical body 6 is seated in an opening 23 provided on the coupling member 2 adjacent to the bent end surface 21 with a shaft inserted into a round hole 22 provided on a vertical portion of the bent end surface 21. To increase a rolling friction of the cylindrical body 6, the latter is preferably provided with, for example, a plurality of dots 62 to form a coarse outer surface, as shown in FIG. 4. With the above arrangements, the cylindrical body 6 contacts with a washer 7 disposed immediately below the coupling member 2 and rolls on the washer 7 about the round hole 22 when the coupling member 2 is brought by the movement 3 to rotate along with the rotary shaft 31, as shown in FIGS. 3 and 4. When the cylindrical body 6 rolls, the rotary magnet 5 inserted therein is continuously turned over and over.

Figure 6:
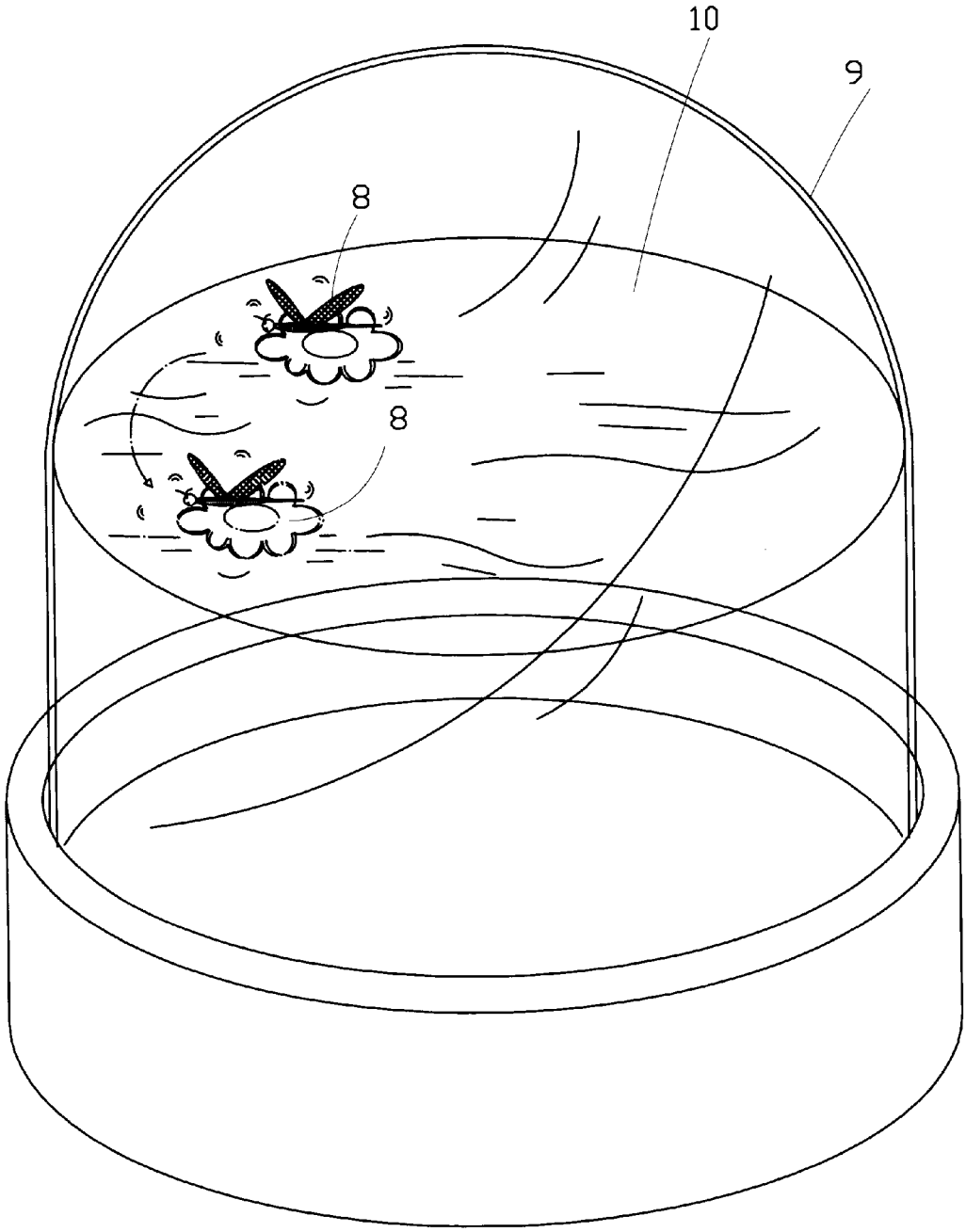
FIG. 6 is a perspective view of a liquid-containing ornament using the present invention.
Figure 7:
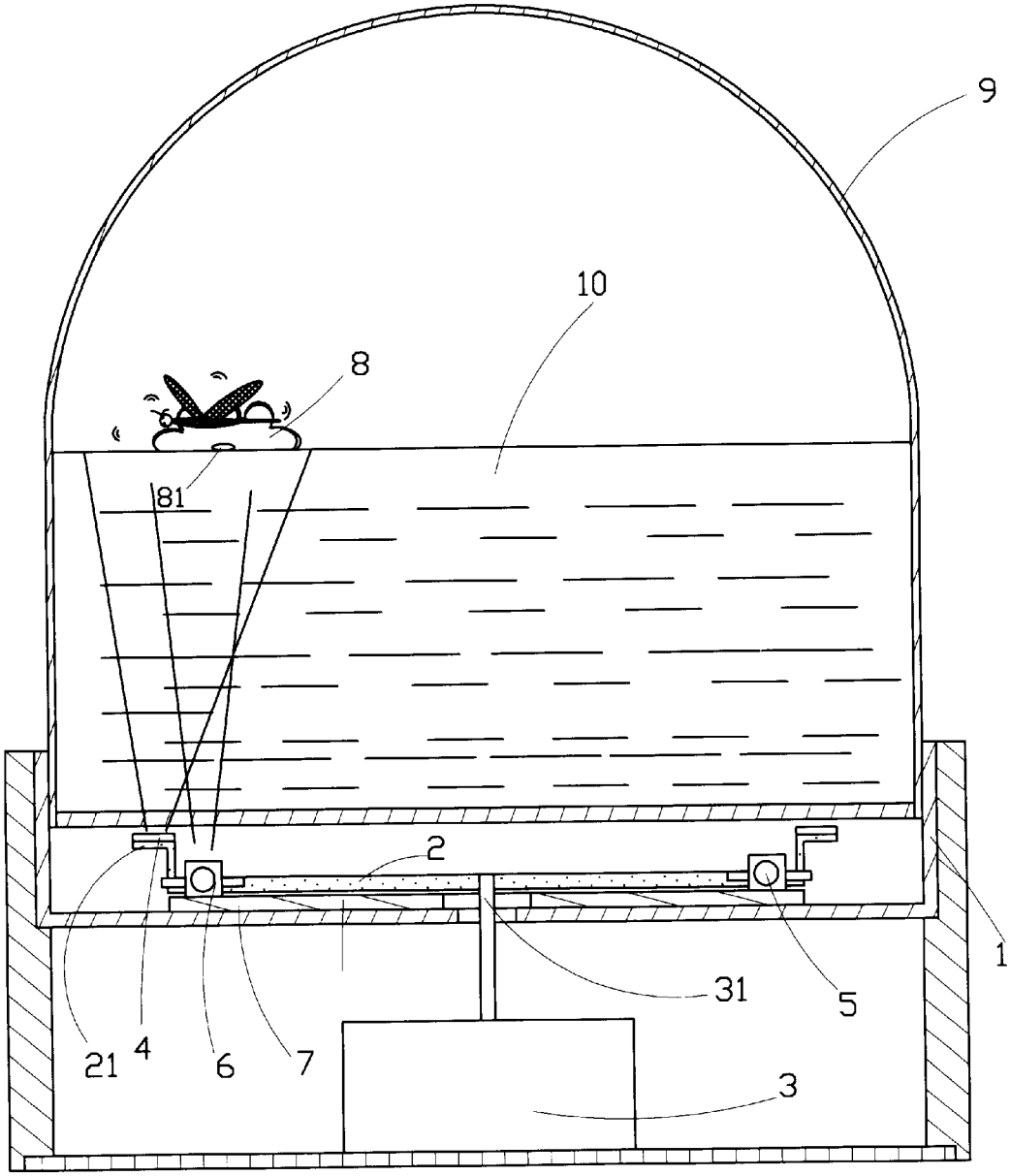
FIG. 7 is a vertical cross section of the liquid-containing ornament of FIG. 6.

Please refer to FIGS. 6 and 7. At least one type of liquid 10 and a plurality of floating ornamental items 8 are contained in the transparent hollow casing 9. Each of the floating ornamental items 8 has a magnet 81 of a predetermined polarity (N or S pole) attached to a bottom side thereof. When the cylindrical body 6 rolls and the at least one rotary magnet 5 is turned over with an end of which having a polarity the same as that of the magnet 81 of one of the floating ornamental items 8 located in a magnetic induction area of the rotary magnet 5, the specific floating ornamental item 8 is pushed away due to a magnetic repulsion. Meanwhile, the magnetically repulsed floating ornamental item 8 is also within a magnetic induction area of the stationary magnet 4 adjacent to the rotary magnet 5, and is therefore magnetically attracted by the stationary magnet 4. That is, when a floating ornamental item 8 is alternately attracted and repulsed by different magnets 4 and 5, it is caused to move in the liquid 10 in the transparent hollow casing 9 just like something real is moving in the liquid 10 to create a unique decorative effect.

What is claimed is:

1. A driving mechanism for a liquid-containing ornament, said liquid-containing ornament including a transparent hollow casing for containing at least one type of liquid, a base in which a movement of a music box having a rotary shaft is mounted, and an intermediate chamber below said casing and above said base; said driving mechanism being located in said intermediate chamber and comprising:

a coupling member provided at a predetermined position with a hole, into which said rotary shaft of said movement of said music box is upward extended, so as to bring said coupling member to synchronously rotate along with said rotary shaft;

at least one stationary magnet having a fixed type of polarity being fixedly mounted on at least one end of said coupling member; and at least one rotary magnet that is mounted on said coupling member such that it rolls to change its polarity when said coupling member is rotating.

2. The driving mechanism for a liquid-containing ornament as claimed in claim 1, wherein said at least one stationary magnet having fixed type of polarity is fixedly mounted on a top surface of an end of said coupling member.

3. The driving mechanism for a liquid-containing ornament as claimed in claim 1, wherein said at least one rotary magnet is mounted on said coupling member in the vicinity of said at least one stationary magnet and may be a spherical or a cylindrical body; in either case, said rotary magnet always having its two different polarities, that is, N pole and S pole, exposed from two opposite ends on an outer surface of said spherical or said cylindrical body.

4. The driving mechanism for a liquid-containing ornament as claimed in claim 3, wherein said at least one rotary magnet is inserted into a radial bore provided on a cylindrical or a spherical body seated in an opening and a shaft hole provided on said coupling member, so that said cylindrical or said spherical body contacts with a washer disposed immediately below said coupling member and rolls on said washer when said coupling member is brought by said movement of said music box to rotate along with said rotary shaft, allowing said at least one rotary magnet to turn over and over to expose said N and S poles thereof.

* * * * *